United States Patent [19]

Bantleon

[11] Patent Number: 4,934,591

[45] Date of Patent: Jun. 19, 1990

[54] CARDBOARD CONTAINER COMPRISING A CYLINDRICALLY WOUND JACKET WITH END CLOSURES

[75] Inventor: Konrad Bantleon, Geislingen/Steige, Fed. Rep. of Germany

[73] Assignee: Michael Hörauf Maschenfabrik GmbH & Co. KG, Donzdorf, Fed. Rep. of Germany

[21] Appl. No.: 416,405

[22] Filed: Oct. 3, 1989

[30] Foreign Application Priority Data

Nov. 15, 1988 [DE] Fed. Rep. of Germany ..... 3838600

[51] Int. Cl.[5] ..... B65D 3/28

[52] U.S. Cl. ..... 229/198.3; 229/4.5; 229/5.5

[58] Field of Search ..... 229/198.3, 4.5, 5.5, 229/5.6, 5.8

[56] References Cited

U.S. PATENT DOCUMENTS

| | | | |
|---|---|---|---|
| 1,923,716 | 8/1933 | Fisher et al. | 229/5.5 |
| 2,789,745 | 4/1957 | Negoro | 229/5.6 |
| 3,190,537 | 6/1965 | Meinecke et al. | 229/5.5 |
| 4,355,756 | 10/1982 | Furuya et al. | 229/4.5 |
| 4,720,039 | 1/1989 | Nishiguchi . | |
| 4,721,242 | 1/1988 | Reil | 229/198.3 |

FOREIGN PATENT DOCUMENTS

| | | | |
|---|---|---|---|
| 2706190 | 8/1978 | Fed. Rep. of Germany | 229/4.5 |
| 1397834 | 3/1965 | France | 229/5.5 |
| 386566 | 1/1933 | United Kingdom . | |

OTHER PUBLICATIONS

Article: "Laminat-Dose von Horauf", Six pages (unnumbered), by Michael Horauf Maschinenfabrik GmbH & Co. KG, Sussen, West Germany.

*Primary Examiner*—Gary Elkins

*Attorney, Agent, or Firm*—Burns, Doane, Swecker & Mathis

[57] ABSTRACT

In a container made of surface protected cardboard, the container jacket is wound overlappingly from a flat blank, and closures are set into the jacket ends. Each closure is provided with a rim to be sealed to the jacket. The inner longitudinal edge of the jacket is covered with a protective strip folded in the shape of a U around that edge. The edge is recessed in the area of the rim to enable legs of the strip to closely approach one another whereby the rim can make a more complete sealing engagement with an inner circumference of the jacket.

12 Claims, 3 Drawing Sheets

FIG. 1
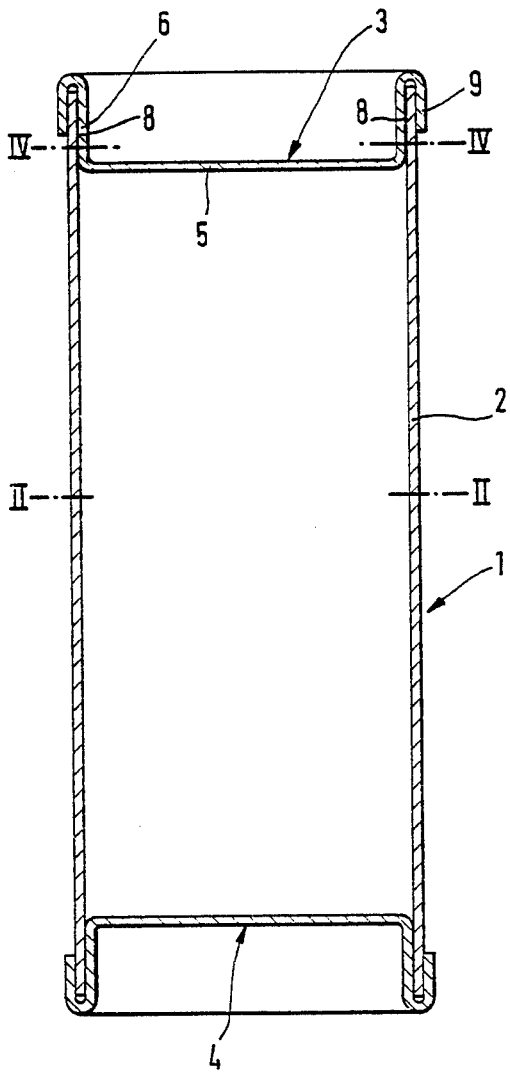
FIG. 5
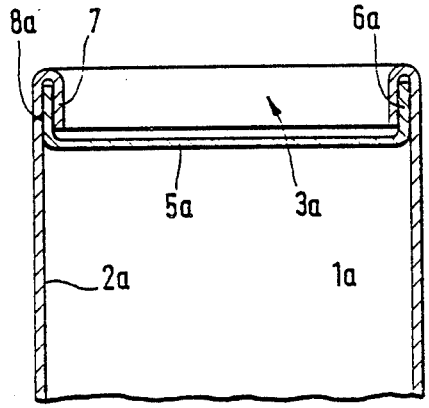
FIG. 6
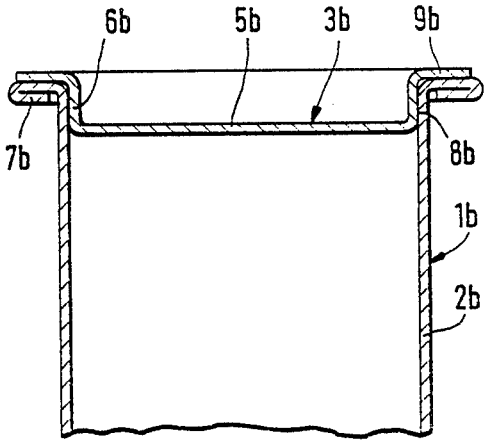
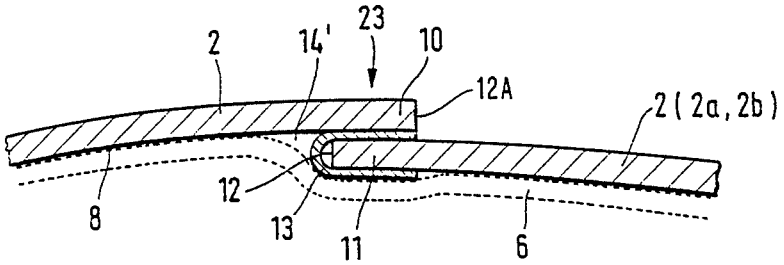
FIG. 2

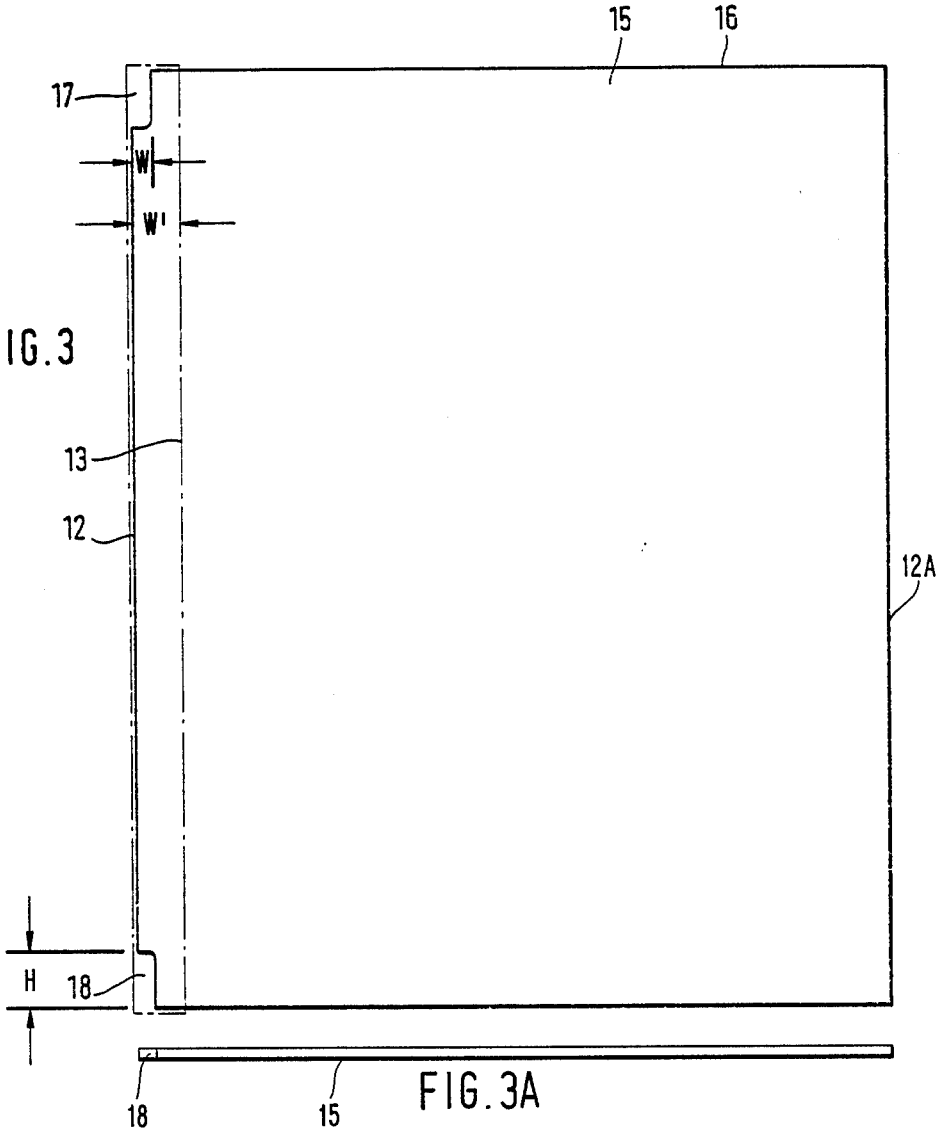
FIG.3
FIG.3A
FIG.4
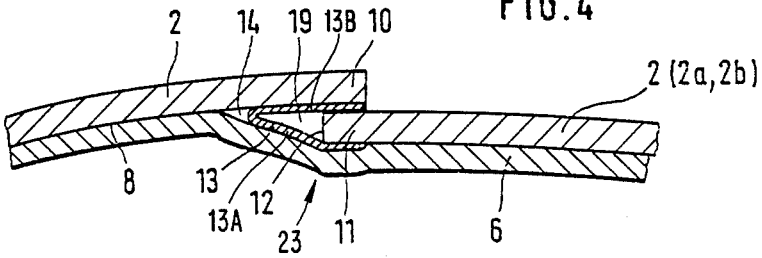

CARDBOARD CONTAINER COMPRISING A CYLINDRICALLY WOUND JACKET WITH END CLOSURES

BACKGROUND OF THE INVENTION

The invention concerns a container made of surface protected cardboard and comprising an overlappingly wound container jacket and at least one end closure provided with a rim, wherein the inner lapped edge is covered by a protective U-shaped strip placed around the edge.

Containers of this type are known (see the brochure entitled "Laminated Tube of Hörauf" of the Michael Hörauf Maschinenfabrik GmbH & Co. KG, West Germany). The protective strip of such containers, which are on the market, is placed in the shape of a U around the inner lapped edge of the jacket, although the strip is not described or shown in the brochure itself.

With containers of this type there are problems relative to sealing around an end closure, if the end closure is provided with a rim. This results from the fact that in the overlapping zone of the wound container jacket, following the insertion of the protective strip and the end closure, a void is created between the closure rim and an inner circumference of the jacket, in which void foreign matter may accumulate.

Another type of cardboard container is depicted in U.S. Pat. No. 4,720,039 in which the protective strip is not folded around the inner longitudinal edge of the jacket, but rather is extended circumferentially thereacross in order to create a steam-release void.

A further type of cardboard container is disclosed in British Patent Specification No. 386,566 wherein no protective strip at all is used. One or both longitudinal edges of the blank is provided with a recess at a mouth of the jacket in order to enable a butt joint to be created at the mouth.

OBJECTS AND SUMMARY OF THE INVENTION

It is an object of the invention to provide a container wherein a protective strip is folded in U-shape around the inner lapped edge of the jacket and wherein the closure rim can be more completely sealed to an inner circumference of the jacket.

This object is attained in that the lapped edge of the blank is provided with a recess in the area of the rim. The recess defines a void which enables legs of the protective strip to more closely approach one another, whereby the rim can better conform to the shape of the inner circumference of the jacket.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 1 is a longitudinal sectional view through a container according to the invention, the closures of which are secured to the ends of the jacket;

FIG. 2 is an enlarged fragmentary cross-sectional view through the container of FIG. 1 along the line II—II, with broken lines depicting how a closure rim would fit against the overlapped region in the absence of the present invention;

FIG. 3 depicts a container blank for making the jacket depicted in FIG. 1 with the protective strip drawn with a dot-and-dash line;

FIG. 3A is an edge view of the blank depicted in FIG. 3;

FIG. 4 is an enlarged fragmentary cross-sectional view taken along the line IV—IV in FIG. 1;

FIG. 5 is a partial longitudinal sectional view through a modified container in which the jacket is bent inward around the rim of the closure;

FIG. 6 is a partial longitudinal sectional view through another modified container in which the jacket is folded outwardly;

DETAILED DESCRIPTION OF PREFERRED EMBODIMENTS OF THE INVENTION

Figure 7:
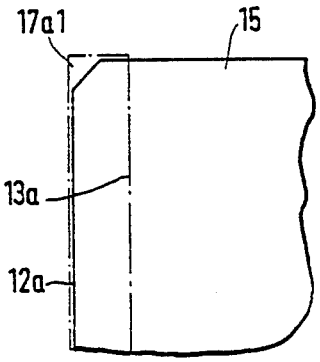
FIGS. 7, 8 and 9 are fragmentary views of a blank depicting different shapes for a recess according to the present invention.

The container 1 shown in a longitudinal section in FIG. 1 has a cylindrical configuration. However, the invention also relates to conical or non-round containers. The container 1 includes a container jacket 2 equipped at its ends with closures 3 and 4. The closures 3, 4 represent a container bottom and a cover, the cover being applied following the filling of the container with a beverage.

Each of the closures 3, 4 contains (as shown for the closure 3), a disk-shaped area 5, to which a rim 6 is connected. The rim can be formed by a beading of the periphery of the disk 3. The rim 6 is folded over the respective end of the jacket 2, so that the rim includes a fold 9 resting against the outside surface of the jacket 2. The closures 3 and 4, including the folds 9 thereof, are sealed to the jacket 2. The abutting surfaces of the jacket 2 and closures 3, 4 are equipped with a sealable lamination. This lamination also serves to protect the surfaces of the carton against penetration by liquids. To prevent leakage of a beverage from the container, the inside of the container, especially at the circumferential interface 8 between the container and the rim 6 (see FIG. 2), must be sealed tightly.

At a circumferential overlap area 23 of the jacket, the outer or overlapping portion 10 of the jacket 2 is overlapped relative to an inner lapped portion 11 subsequent to the winding of the container 1. As mentioned above, the jacket surfaces are protected on their surface by lamination. This, however, is not true for the longitudinally extending cut edges 12, 12A of the jacket blank of which the inner cut edge 12 is especially susceptible to the penetration of a liquid. For this reason, i.e., since the inner cut edge 12A may come into contact with the beverage, the edge 12 is covered by a protective strip 13 comprising a thin foil folded U-shaped around the cut edge 12 and sealed in this location. The strip thus includes two longitudinal legs lying on opposite sides of the edge 12.

FIG. 2 shows that the cross-section of the container 1 (also of the containers 1a and 1b to be later discussed) is of enlarged radial thickness in the overlap area 23. That is, the wall thicknesses of the portions 10 and 11 of the jacket are additive, to which two wall thicknesses of the protective strip 13 are further added. Over the rest of the circumference of the jacket 2 there is only one wall thickness, i.e., that of the jacket 2. If, as indicated in the cross-section of FIG. 2 by broken lines, the rim 6 of a closure 3 were set into the jacket 2, there would be problems regarding the tightness desired. It is readily seen in FIG. 2 that if a closure were applied to the jacket, there would be formed a void 14' between the rim 6 and the overlapped region 23. Foreign matter can accumulate in such a void.

According to the invention, however, measures are provided to remedy this condition. The blank 15 for the container 1 comprises according to FIG. 3 a vertical cut edge 12, which is covered in the above-described manner by a protective strip 13 indicated by a dash-and-dot line. The cut edge 16 which is uppermost in FIG. 3, is circular after the winding of the jacket 2, thus forming an end edge of the jacket. At the front and rear ends of the edge 12 which later will receive the rims 6 of the closures 3 and 4, the cut edge 12 is provided with rectangular recesses 17 and 18. A longitudinal dimension or height H of each recess corresponds essentially to the height of the rim 6, and the width W of each recess amounts to approximately one-half of the width W' of the folded-over section of the protective strip 13.

Due to the presence of the recesses 17 and 18, a void 19 is formed between the longitudinal legs of the strip 13 and the edge 12 of the inner portion 11 of the jacket at each end of the jacket as may be seen in FIG. 4. FIG. 4 is an enlarged partial cross-section on the section surface IV—IV of FIG. 1, with this partial cross-section being applicable also for the containers 1a and 1b of FIGS. 5 and 6. It is seen in FIG. 4 that in the area of the void 19, the circumferential length of the overlapping area 23 is smaller than in the other areas of the jacket (compare FIG. 2).

In the area of the void 19, the inner lateral part 13A of the protective strip 13 may be moved closer toward the lateral part 13B thereof upon the insertion of the rim 6 of the closure 3 or 4, so that a softer or tapered transition is created in the area of the overlap 23. That is, in the area of the void 19, the strip 13 acts like a flexible "bag" which can be readily deformed to create a transition which is more gradual than the abrupt transition shown in FIG. 2. Accordingly, the legs of the strip 13 bordering the recess 17 (or 18) are disposed closer together than portions of the legs which border the remaining non-recessed segment of the edge 12. Hence, the void 14 formed between the rim 6 and the inner surface of the outer portion 10 is much smaller, because the rim 6 can more clearly approach the edge 12 than was previously possible. It is thus possible in this manner to seal the rim 6 to the jacket 2 such that a higher degree of tightness is obtained.

The invention is also applicable to a closure 3a depicted in FIG. 5 in which the jacket 2a is folded with a fold 7 around the rim 6a of the closure 3a. In such a container 1a, the closure 3a has a disk-shaped area 5a, which on the circumference evolves into a rim 6a. The rim at the circumferential sealing location 8a, must be tightly sealed to the jacket 2a.

The invention may also be applied to a container 1b depicted in FIG. 6 in which the jacket 2b is folded with a fold 7b outward in the area of the closure 3b. The associated closure 3b which comprises a disk-shaped area 5b and a rim 6b has an annular flange 9b which rests on the fold 7b. Here again, a light tight seal must be obtained in the circumferential area 8b.

Figure 8:
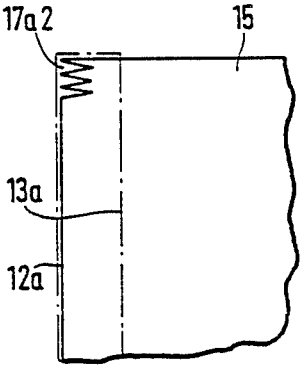
Figure 9:
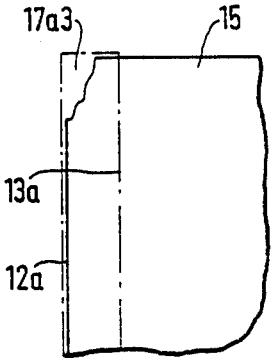

The views according to FIGS. 7, 8 and 9, depict a blank 15 for a container 1 of the type depicted in FIG. 1, and show alternative ways of creating the void 19. Thus, the recess 17a1 according to FIG. 7 is triangular, while the recesses 17a2 and 17a3 according to FIGS. 8 and 9 are of serrated (zig-zag) and wavy shapes, respectively. But in each of these cases, in the area of the overlap 23, a softer transition is obtained at the rim 6, which is conducive to tightness.

Figure 10:
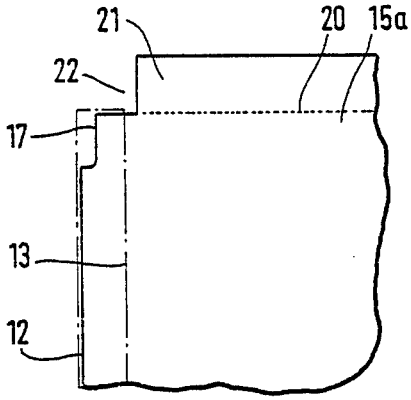
FIG. 10 depicts a part of a blank for forming the jacket depicted in FIG. 5.
Figure 11:
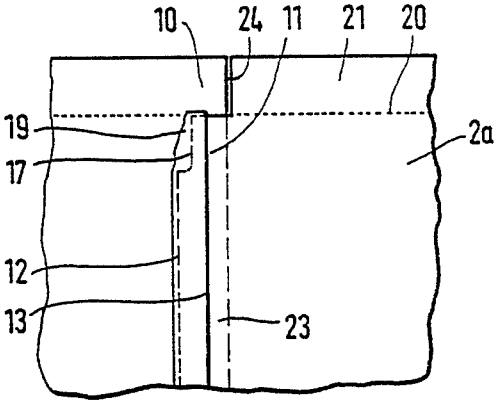
FIG. 11 depicts the blank of FIG. 10 after the winding step but before folding a longitudinal extension of the blank.

FIG. 10 depicts a blank 15a for making the container 1a according to FIG. 5. The blank may be longer than the sealing strip 13. An imaginary line 20 forms a fold line around which the jacket 2 is folded over after the winding step, as shown in FIG. 5. The upper portion 21 of FIG. 10 thus corresponds to the fold-over 7 of FIG. 5. To ensure that no excessive radial thickening occurs in the area 23, the upper portion 21 is provided with an additional rectangular recess 22, but with the circumferential width of that recess being slightly greater than the width of the folded over protective strip 13. Accordingly, after the winding step, the jacket 2 has an opposing longitudinal edge 24 flush with or abutting a longitudinal edge of the additional recess 22 (see FIG. 11). The view in FIG. 11 is such that the overlap 23 is seen from the inside of the container 1. The void 19 enclosed by the sealing strip 13 is again seen; it is slightly compressed also in the circumferential direction of the container 1. Following the sealing of the closure 3a, the portion 21 of the jacket 2a is folded inward, as seen on the container 1a according to FIG. 5.

Figure 12:
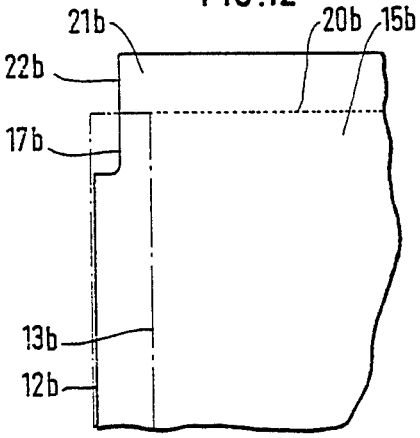
FIG. 12 depicts a part of a blank for forming the jacket depicted in FIG. 6.
Figure 13:
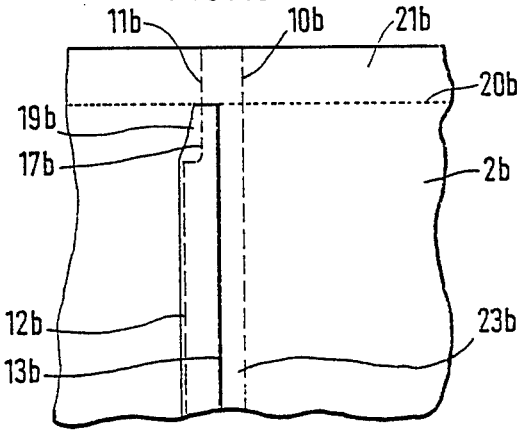
FIG. 13 depicts the blank of FIG. 12 after the winding step but before folding a longitudinal extension of the blank.

The blank 15b according to FIG. 12 is used to form the container 1b of FIG. 6, in which an upper portion 21b projecting beyond the sealing strip 13b is folded outward prior to the insertion of the closure piece 3b and is pressed to form an edge flange 7b, on which an annular flange 9b of the closure 3b may rest. In this case, the recess 17b associated with the void 19 according to the invention is extended toward the end of the blank 15, as in this case, the circumferential width of the additional recess 22b is less than the width of the protective strip 13b. The jacket 2b thus remains overlapping even after winding according to FIG. 13 in the area of the portion 21b, with the overlap 23b being slightly narrower in the area of the portion 21b than in the rest of the jacket. In this case, the accumulation of material in the fold-over 17b is not as detrimental as in other embodiments as the fold-over itself is not resting directly on the jacket itself. According to FIG. 13, here again, the diminished void 19b enclosed by the protective strip 13b is seen; it serves to improve sealing along the rim 6b of the closure 3b.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A container comprising a jacket formed of an overlappingly wound blank and at least one end closure mounted at a longitudinal end of said jacket, said blank and said end closure formed of a surface-protected cardboard, said end closure including a rim extending circumferentially around an inner surface of said jacket, said jacket including an outer portion overlapping an inner portion thereof, said inner portion including a longitudinally extending edge, a protective strip folded in U-shape around said edge such that one leg of said folded strip engages an outer surface of said inner portion and another leg thereof engages an inner surface of said inner portion; said edge including a recess adjacent said end whereby portions of said legs of said strip bordering said recess are disposed closer together than portions of said legs bordering a non-recessed segment of said edge.

2. A container according to claim 1, wherein a longitudinal dimension of said recess corresponds substantially to a longitudinal dimension of said rim.

3. A container according to claim 1, wherein a circumferential dimension of said recess corresponds to approximately half of a circumferential dimension of each said leg of said strip.

4. A container according to claim 1, wherein said recess is generally rectangular.

5. A container according to claim 1, wherein said recess is generally triangular.

6. A container according to claim 1, wherein said recess is of serrated shape.

7. A container according to claim 1, wherein said recess is of wave shape.

8. A container according to claim 1, wherein said jacket includes a longitudinal extension which is folded.

9. A container according to claim 8, wherein said extension is folded inwardly upon said end closure.

10. A container according to claim 8, wherein said extension is folded outwardly, with a portion of said end closure overlying said extension.

11. A container according to claim 8, wherein said edge is provided with an additional recess adjacent said extension.

12. A container according to claim 8, wherein said additional recess has a longer circumferential dimension than said first-named recess, and opposite longitudinal edge of said blank being wound so as to lie substantially flush with a longitudinal edge of said additional recess.

* * * * *